United States Patent [19]

Moliard

[11] 4,239,411

[45] Dec. 16, 1980

[54] LOCKING DEVICE FOR VISIBLE RECORD BINDERS

[76] Inventor: Henry Moliard, 942 Avenida Central, Guadalupe (S.V.), Costa Rica

[21] Appl. No.: 19,088

[22] Filed: Mar. 9, 1979

[51] Int. Cl.[3] ..... B42F 13/00

[52] U.S. Cl. ..... 402/77; 402/80 R

[58] Field of Search ..... 402/2, 4, 31, 36, 75–77, 402/73, 74, 80 R

[56] References Cited

U.S. PATENT DOCUMENTS

| | | | |
|---|---|---|---|
| 121,671 | 12/1871 | Shannon | 402/80 R |
| 1,496,335 | 6/1924 | Bennett | 402/2 |
| 1,754,471 | 4/1930 | Krag | 402/75 |
| 1,811,348 | 6/1931 | Burgoyne | 402/80 R |
| 2,208,231 | 7/1940 | Russell | 402/75 |

FOREIGN PATENT DOCUMENTS

| | | | |
|---|---|---|---|
| 18858 | of 1900 | United Kingdom | 402/31 |

*Primary Examiner*—Paul A. Bell

*Attorney, Agent, or Firm*—Hill, Van Santen, Steadman, Chiara & Simpson

[57] ABSTRACT

A visible record loose-leaf binder for pages of strip sheet material arranged in partially overlapped fashion has a hinged cover to which are attached L-shaped members having a plurality of prongs thereon. The prongs extend through perforations in the sheet material to maintain the sheets in the binder. Sets of compensating pads having increasing height from the center of the binder to its upper and lower edges are provided to maintain the overlapped sheet material in substantially flat configuration when the binder is closed, and also provide a flat writing surface when the binder is opened. The L-shaped members are hinged together and held in opposed relation by a band surrounding the members. The band may have an internally or externally accessible locking means for opening and closing thereof.

9 Claims, 9 Drawing Figures

LOCKING DEVICE FOR VISIBLE RECORD BINDERS

BACKGROUND OF THE INVENTION

1. Field of the Invention

This invention relates to loose-leaf binders for pages of partially overlapping strip sheet material in particular binders such as are used to hold accounting ledgers.

2. Description of the Prior Art

Visible record binders such as the type commonly used to record accounting information have narrow sheets which partially overlap each other leaving a visible border along the edges of all of the sheets on which the information to be recorded is written. The overlapping sheets thus present a list of names, titles or other information which is visible at a glance without the necessity of turning through a large sheaf of pages or cards to obtain the desired information. Ordinary binders having sheets therein of identical size only present information on one page at a time, and are therefore impractical for use when information on a number of pages is desired to be viewed at once.

The overlapping pages are held in such binders by a plurality of prongs mounted on upper and lower covers of the binder and extending through perforations in the pages. The prongs are generally maintained in a closed loop to prevent accidental removal of pages by a relatively heavy and usually expensive locking means, which is generally operated from the top and bottom of the binder. Use of such a locking and release mechanism required that the cover structures holding the prongs be sturdy, resulting in covers for such binders comprised of generally thick material. When the binder is full of pages, operation of such locking devices is somewhat clumsy, and because such devices contain a number of parts in sliding relationship, they are rather fragile and easily dislocated.

Another disadvantage of binders known in the art is that because of the overlapping nature of the sheets contained therein, the sheaf of pages in the binder is not of uniform thickness. Generally, the sheaf will be thickest at a central portion where the number of overlapping pages is greatest, and decreases in thickness toward the top and bottom of the sheaf, where the number of overlapping pages decreases. This presents two problems. The first is that the binder covers rest only against the thickest portion of the sheaf, so that handling and storage of such binders puts uneven pressure on the binder cover frequently resulting in stresses which shorten the usable life of the binder. A second problem resulting from the uneven thickness of the pages is that an uneven writing surface is presented for recording information on the borders of the overlapping pages. This not only results in uncomfortable writing for the information recorder, but also may impair the legibility of the information recorded.

SUMMARY OF THE INVENTION

A loose-leaf visible record binder is provided with generally parallel front and back covers and a back portion hingedly attached generally perpendicular to one edge of each of said covers. The back portion is comprised of two segments which are also attached by means of vertical hinges. An L-shaped member is attached to each segment of the back portion so that when the binder is closed the two L-shaped members form a channel. A plurality of upwardly extending prongs are carried on one L-shaped member and a like number of downwardly extending prongs are carried on the other L-shaped member. The L-shaped members are maintained in relation to form the channel by means of a detachable band extending around the periphery of the members. The prongs extend through perforations in the pages to be bound to hold the pages in the binder.

A number of compensating pads are provided to cooperate with the overlapping pages to form a generally flat sheaf of bound material. The pages on which the information is recorded generally overlaps so that the pages have a thickest central portion and decrease in thickness toward the top and bottom of the sheaf of pages. The compensating pads are constructed to provide a mirror image surface, which is lowest at a central portion and highest at the top and bottom, so that when combined with the pages the thick central portion of the pages rests on the low central portion of the compensating pad, and the thinner portions of the pages rest on the higher portion of the compensating pads.

It is an object of the present invention to provide a visible record binder which stores overlapping sheets of paper and also provides easy access for removal or redistribution of the pages.

It is another object of the present invention to provide a visible record binder having a lightweight, inexpensive and easily used means for holding the pages in the binder.

Another object of the invention is to provide compensating pads so that the sheaf of bound material in the binder is of uniform thickness, thereby minimizing uneven stresses on the binder, and increasing its useful life.

It is a further object of the present invention to provide compensating pads which cooperate with the varying thicknesses of the bound pages to provide a flat writing surface for improved ease of recording information and improved legibility of the information recorded.

DESCRIPTION OF THE PREFERRED EMBODIMENTS

Figure 1:
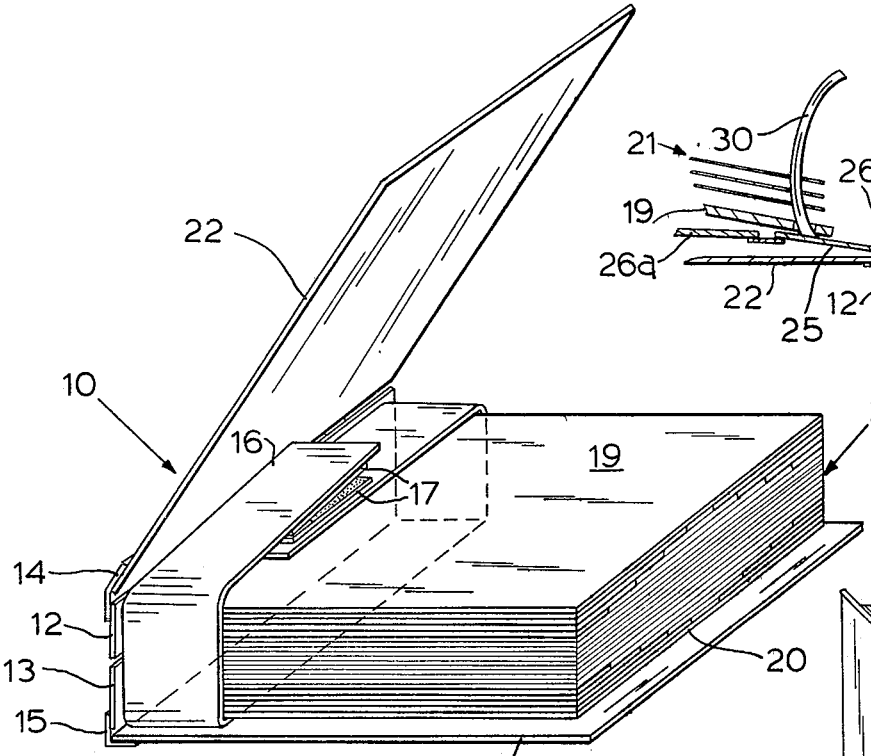
FIG. 1 shows a perspective view of a visible record binder.

A visible record binder is shown generally at 10 in FIG. 1. The binder 10 has a front cover 22 and a rear cover 11. A back portion of the binder has two segments 12 and 13 disposed generally perpendicularly to the front and back covers. The segment 12 is attached to the front cover 22 by means of a flexible hinge 14 and the back segment 13 is attached to the rear cover 11 by a similar flexible hinge 15. The hinges 14 and 15 may be comprised of flexible binding tape or other suitable material.

A sheaf of overlapping pages 21 is maintained in the binder by a binding means discussed in detail below. An upper compensating pad 19 and a lower compensating pad 20 are also maintained in the binder 10 so that the entire sheaf of bound material is of even thickness.

Figure 8:
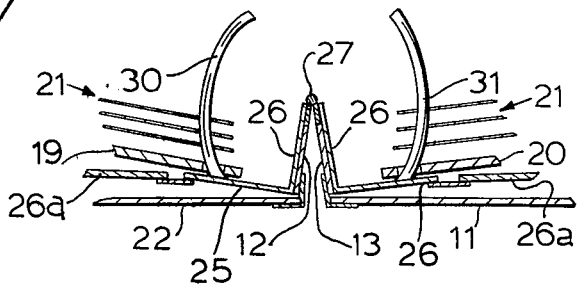
FIG. 8 is a side view of the binder of FIG. 2 in open position.
Figure 1A:
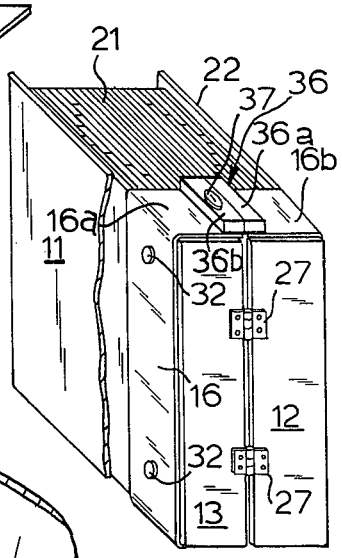
FIG. 1*a* is a perspective view partially broken away of the binder of FIG. 1 with a modified band-closing means.
Figure 2:
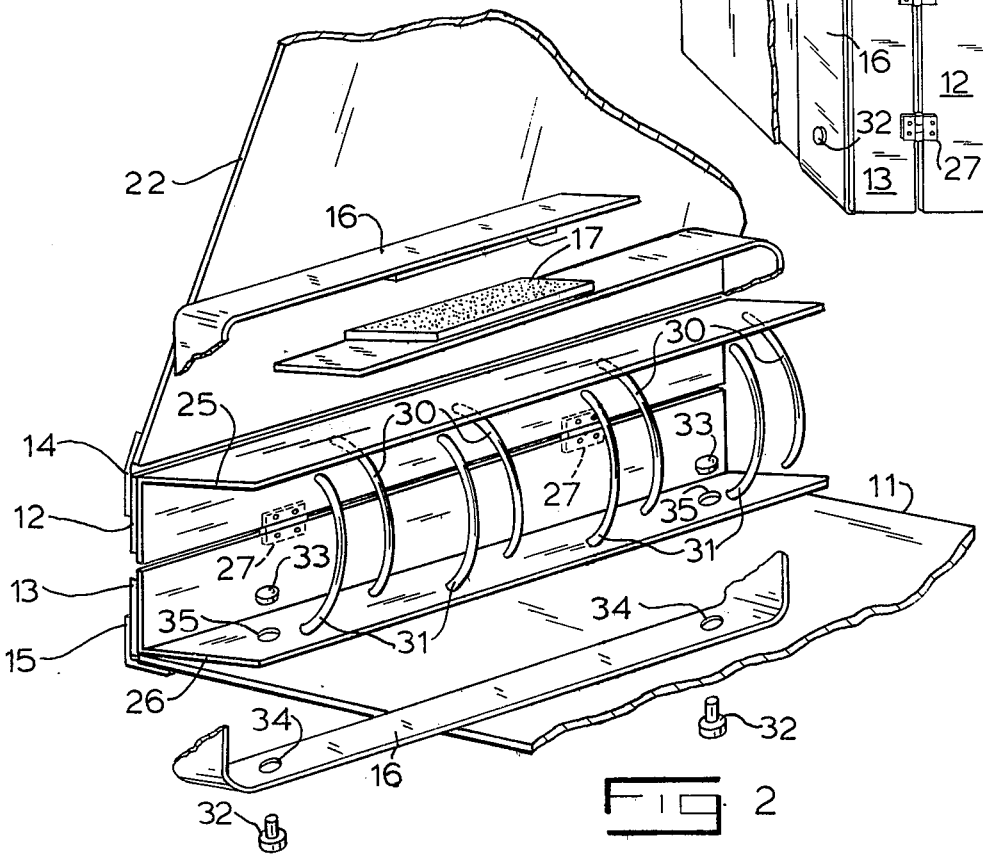
FIG. 2 is a perspective view of the binder of FIG. 1 with the pages removed.

The means for maintaining the bound material in the binder 10 is shown in detail in FIGS. 2 and 8. An L-shaped member 25 is attached to the back segment 12 and a similar L-shaped member 26 is attached to the back segment 13. The L-shaped members 25 and 26 are attached by means of hinges 27 so that when closed the members 25 and 26 form a rectangular channel. The member 25 has four downwardly extending prongs 30 and the member 26 has four upwardly extending prongs 31. It will be understood that the number of prongs 30 and 31 may be varied, and the numbers shown in the drawings is for illustrative purposes only.

A flexible band 16 surrounds the outer periphery of the L-shaped members 25 and 26 and is attached to the member 26 by means of grommets 32 which extend through aligned holes 34 and 35 in the band 16 and the member 26 respectively. The grommets are held in place by rings 33. Any other suitable attachment means may also be utilized, and the grommets 32 are shown for illustrative purposes only. The band 16 has ends which can be removably connected by means of velcro strips 17. When the strips 17 are in engagement, the band 16 maintains the L-shaped members 25 and 26 in the form of a channel so that the bound material through which the prongs 30 and 31 extend is maintained in the binder.

As shown in FIG. 8, an additional stiff sheet **26*a* may be hinged to one edge of each of the L-shaped members 25 26 to provide added ease of opening on use. When the band 16 is detached and the binder opened, the prongs 30 and 31 are no longer in a closed loop configuration so that removal or redistribution of the pages 21 or the compensating pads 19 and 20** may be accomplished.

A binder having modified closing means 36 is shown in upright position in FIG. **1*a*. The closing means 36 is disposed at the top of the binder for external access. The closing means 36 may include a lock 37 for use with a key, or any other suitable fastening means. The closing means 36 is separable into two sections 36*a* and 36*b* respectively attached to free ends of the band 16**.

Figure 3:
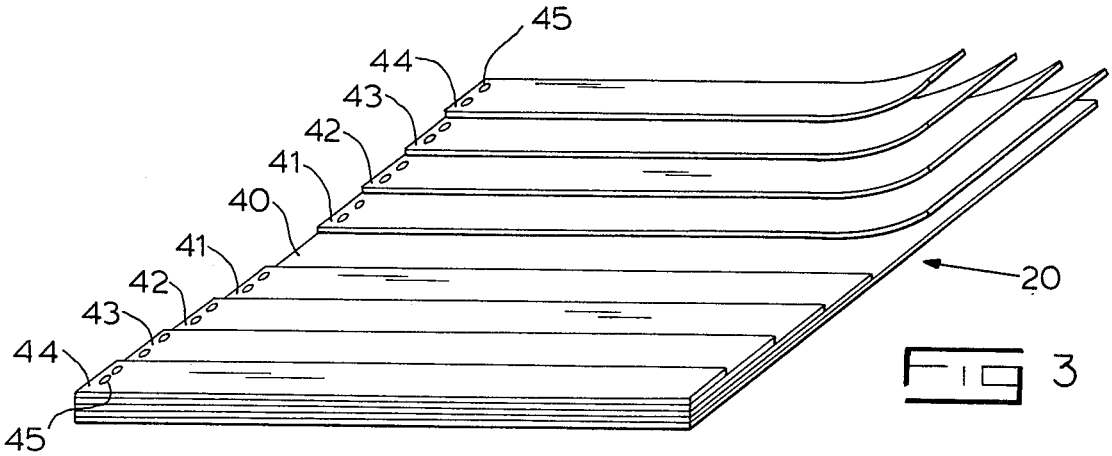
FIG. 3 is a perspective view of a compensating pad for use in the binder of FIG. 1.

A compensating pad 20 is shown in detail in FIG. 3. The pad consists of a number of overlapping strips which are all attached to a base sheet 40. Strips 41, 42, 43 and 44 of decreasing width are placed over the base sheet 40 in ascending fashion so that the compensating pad 20 has a lowest portion at its center and a highest portion at its top and bottom. The other dimensions of the strips 41 through 44 are identical to the base strip 40. A plurality of perforations 45 are disposed at one edge of the compensating pads 20 for engagement with the prongs 30 and 31. The strips 41 through 44 are attached at the edge thereof having the perforations 45 so that the strips are maintained in fixed relation to the base 40.

Figure 4:
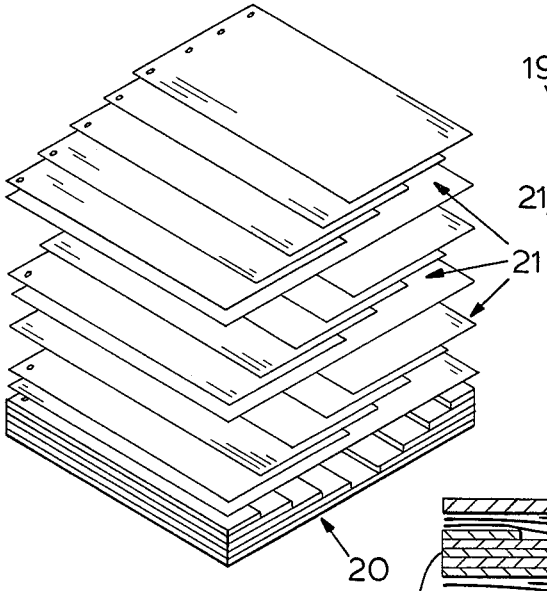
FIG. 4 is an exploded view showing a number of sheaves of bound material in cooperation with the compensating pad of FIG. 3.
Figure 5:
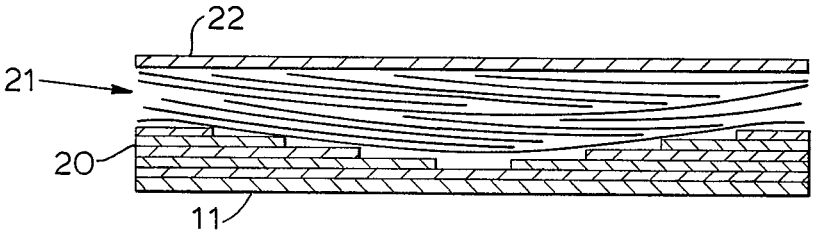
FIG. 5 shows an end view of a binder containing a compensating pad and a number of sheaves of paper.

Utilization of a number of compensating pads 20 in connection with sheaves of paper 21 in the binder 10 are variously shown in FIGS. 4 through 7. FIG. 4 shows an exploded view of a number of sheaves of paper 21 disposed above a single compensating pad 20. It is desirable to use a compensating pad for each sheaf of overlapping information recording pages which is bound in the binder 10, however, as shown in FIG. 5, even if a single compensating pad 20 is utilized with a number of sheaves 21, an improvement in the uniform thickness of the bound material still results.

Figure 7:
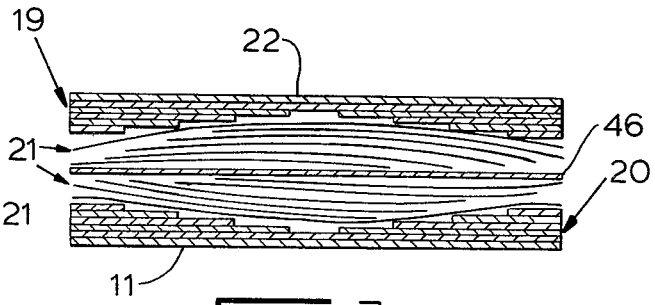
FIG. 7 shows an end view of a binder containing oppositely disposed compensating pads cooperating with two sheaves of paper.
Figure 6:
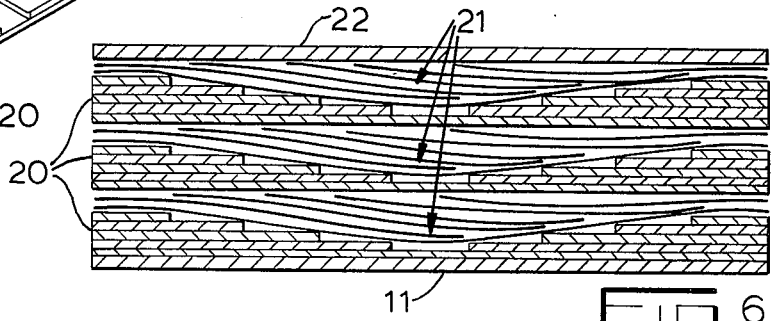
FIG. 6 shows an end view of a binder containing an equal number of compensating pads and sheaves of paper.

Preferred use of the compensating pads 20 with sheaves of paper 21 is shown in FIGS. 6 and 7. In FIG. 6, a compensating pad 20 is provided for each sheaf of information recording pages 21 so that a number of piles of uniform thickness are provided stacked one on top of the other. As shown in FIG. 6, when the compensating pads 20 are used in the binder the front cover 22 and the rear cover 11 will be maintained in substantially parallel relation.

A second configuration is shown in FIG. 7 wherein oppositely disposed sheaves of information recording pages 21 are disposed between two oppositely disposed compensating pads 19 and 20. A divider sheet 46 is placed between the sheaves 21 to separate the pages. Again, the compensating pads 20 cooperate with the sheaves of paper 21 to provide a stack of uniform thickness so that the front cover 22 and the rear cover 11 of the binder are in substantially parallel relation.

Although changes and modifications of the invention may be apparent to those skilled in the art it is the intention of the applicant to embody within the patent warranted hereon all such changes and modifications as may reasonably and properly be included within the scope of applicant's contribution to the art.

I claim as my invention:

1. A visible record loose-leaf binder for pages of perforated strip sheet material in partially overlapped relation comprising:

a pair of rigid angle strips having legs in right angle relation;

hinges connecting free end edges of one leg of each strip to permit swinging of the strips from a closed position with the hinged legs in aligned superimposed relation and the other legs extending therefrom to provide a channel to an open position with the hinged legs in back to back relation and the other legs extending outwardly therefrom in opposite directions to provide opposed L-configurations;

first and second sets of prongs spaced along the length of the other legs of the angle strips cooperating to define closed end rings when the angle strips are in the closed channel position and defining upwardly projecting hooks when the strips are in the open L-configuration, said prongs projecting through the perforations of the strips in both the open and closed positions;

a tape secured to the other leg of one strip having free ends adapted to be wrapped around the other strip in the closed channel position of the strips;

means carried by said free ends of the tape releasably securable to lock the strips in the closed position;

book covers hinged to the angle strips independently swingable with respect to said strips from closed positions overlying the closed channel position of the strips and tape to open positions exposing the sheet material, whereby said covers may be opened and closed while said strips and tape remain locked in a closed position; and compensating pads of strips between the pages having the strips arranged thereon to cooperate with the pages for forming a stack of uniform thickness along the full lengths of the angle strips.

2. The binder of claim 1 wherein the page strips form a stack of increasing height from top and bottom ends to a central portion and the compensating pads have correlated strips increasing in height from the middle to the ends thereof so that the assembled pages and pads will provide a stack of uniform height.

3. The binder of claim 1 wherein a plurality of sets of partially overlapped strip sheet material cooperate with a like number of compensating pads to form a stack of sheet material and pads of uniform thickness.

4. The binder of claim 1 wherein two compensating pads are oppositely disposed each adjacent one of said covers and two sets of partially overlapped strip sheet material are disposed between said compensating pads separated by a flat divider to provide a stack of uniform thickness inside said binder.

5. A loose-leaf binder for retaining perforated pages of sheet material comprising:

a pair of rigid angle strips having legs in right angle relation;

hinges connecting free end edges of one leg of each strip to permit swinging of the strips from a closed position with the hinged legs in aligned superimposed relation and the other legs extending therefrom to provide a channel to an open position with the hinged legs in back-to-back relation and the other legs extending outwardly therefrom to provide opposed L-configurations;

first and second sets of prongs spaced along the length of the other legs of the angle strips cooperating to define closed end rings when the angle strips are in the closed channel position and defining upwardly projecting hooks when the strips are in the open L-configuration, said prongs projecting through the perforations in the pages in both the open and closed position and permitting removal of the pages in the open position;

a tape attached to the other leg of one angle strip having free ends adapted to be wrapped around the other angle strip when the strips are in the closed channel position;

means for releasably securing the free ends of said tape to each other to lock the angle strips in the closed position to hold the pages in the binder in an aligned stack, covers hingedly attached to said angle strips swingable to a closed position covering said strips, tape and pages and to an open position exposing said strips, tape and pages in a locked position.

6. The binder of claim 5 wherein said means for releasably securing the free ends of said tape is externally accessible at a top of said binder.

7. The binder of claim 5 wherein said means for releasably securing the free ends of said tape is provided with a key-actuated locking mechanism.

8. The binder of claim 5 including stiff sheets attached to and extending from said other legs of the angle strips to facilitate opening of the binder.

9. The binder of claim 8 wherein the stiff sheets are hinged to said other legs of the angle strips.

* * * * *